US009388945B2

(12) United States Patent
Bemis et al.

(10) Patent No.: US 9,388,945 B2
(45) Date of Patent: Jul. 12, 2016

(54) SYSTEM FOR EMULSION ASPIRATION

(71) Applicant: Bio-Rad Laboratories, Inc., Hercules, CA (US)

(72) Inventors: Adam Bemis, Los Altos Hills, CA (US); Thomas H. Cauley, III, Pleasanton, CA (US); Klint Rose, Alviso, CA (US); James M. Hamilton, Sunnyvale, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 105 days.

(21) Appl. No.: 14/170,875

(22) Filed: Feb. 3, 2014

(65) Prior Publication Data

US 2014/0216579 A1 Aug. 7, 2014

Related U.S. Application Data

(60) Provisional application No. 61/759,765, filed on Feb. 1, 2013.

(51) Int. Cl.

| | |
|---|---|
| ***B01L 3/02*** | (2006.01) |
| ***F17D 3/00*** | (2006.01) |
| *B01F 9/00* | (2006.01) |
| *B01F 5/00* | (2006.01) |

(52) U.S. Cl.

CPC ..... *F17D 3/00* (2013.01); *B01F 5/0068* (2013.01); *B01F 5/0071* (2013.01); *B01F 5/0074* (2013.01); *B01F 2009/0092* (2013.01); *B01F 2009/0094* (2013.01); *B01F 2009/0098* (2013.01); *Y10T 137/86083* (2015.04)

(58) Field of Classification Search

USPC ..... 422/516

See application file for complete search history.

(56) References Cited

U.S. PATENT DOCUMENTS 5,225,164 A 7/1993 Astle
5,534,227 A * 7/1996 Lahm ..... B01L 3/50255 422/536

(Continued)

FOREIGN PATENT DOCUMENTS

WO 9846981 A1 10/1998
WO 2011012905 A2 2/2011

OTHER PUBLICATIONS

Blaine R. Copenheaver, Authorized Officer, International Searching Authority, U.S. Patent and Trademark Office, "International Search Report" in connection with related PCT Patent Application Serial No. PCT/US2014/014390, dated May 20, 2014, 2 pages.

(Continued)

*Primary Examiner* — Jill Warden
*Assistant Examiner* — Brittany Fisher
(74) *Attorney, Agent, or Firm* — Kolisch Hartwell, P.C.

(57) ABSTRACT

System, including apparatus and methods, for aspirating at least a portion of an emulsion from a well using a tip. In some embodiments, the tip may have a flat end and an inlet surrounded by the flat end. The well may have a floor with one or more surface features that prevent uninterrupted circumferential contact of the flat end of the tip with any region of the floor. In some embodiments, the tip may not have a flat end. In some embodiments, the well may have a port that guides the tip to the floor with the tip slanted with respect to the floor. Methods of making a device that includes the well are also disclosed.

17 Claims, 8 Drawing Sheets

(56) References Cited

U.S. PATENT DOCUMENTS

| | | | | |
|---|---|---|---|---|
| 2004/0087005 | A1 | 5/2004 | Henderson et al. | |
| 2005/0250097 | A1* | 11/2005 | Duffy | B01L 3/5085 435/6.11 |
| 2009/0042256 | A1* | 2/2009 | Hanafusa | B01L 3/5027 435/91.2 |
| 2009/0054262 | A1* | 2/2009 | Abbott | B01L 3/5085 506/12 |
| 2009/0081083 | A1* | 3/2009 | Clark | B01J 20/28026 422/400 |
| 2009/0170183 | A1 | 7/2009 | Büchs | |
| 2010/0103410 | A1* | 4/2010 | Silbergleit | B01L 3/5085 356/246 |
| 2010/0184235 | A1* | 7/2010 | O'caoimh | B01L 3/5085 436/180 |
| 2010/0190170 | A1 | 7/2010 | Yu et al. | |
| 2011/0092392 | A1* | 4/2011 | Colston, Jr. | B01F 3/0807 506/27 |
| 2013/0037059 | A1* | 2/2013 | Stafford | B01L 3/5085 134/21 |

OTHER PUBLICATIONS

Blaine R. Copenheaver, Authorized Officer, International Searching Authority, U.S. Patent and Trademark Office, "Written Opinion of the International Searching Authority" in connection with related PCT Patent Application Serial No. PCT/US2014/014390, dated May 20, 2014, 12 pages.

* cited by examiner

SYSTEM FOR EMULSION ASPIRATION

CROSS-REFERENCE TO PRIORITY APPLICATION

This application is based upon and claims the benefit under 35 U.S.C. §119(e) of U.S. Provisional Patent Application Ser. No. 61/759,765, filed Feb. 1, 2013, which is incorporated herein by reference in its entirety for all purposes.

CROSS-REFERENCES TO OTHER MATERIALS

This application incorporates by reference in their entireties for all purposes the following patent documents: U.S. Pat. No. 7,041,481, issued May 9, 2006; U.S. Patent Application Publication No. 2010/0173394 A1, published Jul. 8, 2010; U.S. Patent Application Publication No. 2011/0217712 A1, published Sep. 8, 2011; U.S. Patent Application Publication No. 2012/0152369 A1, published Jun. 21, 2012; U.S. Patent Application Publication No. 2012/0190032 A1, published Jul. 26, 2012; and U.S. Patent Application Publication No. 2013/0269452 A1, published Oct. 17, 2013.

INTRODUCTION

A sample partitioned into an emulsion can provide an efficient strategy for assaying the sample. The sample can be partitioned into a large number of droplets separated from one another by a carrier phase. Each droplet then can function as a separate chamber for performing a reaction. Utilization of an emulsion-based strategy for assay of a sample can provide substantially increased sensitivity, accuracy, and speed, among other benefits, over more traditional approaches.

Emulsion-based assays often rely on droplets maintaining their integrity from the moment the droplets are formed until data is collected from the droplets. Droplets that change in size in an uncontrolled and unpredictable manner can degrade assay performance substantially. If the altered droplets can be identified reliably, they can be excluded from the collected data, although still consuming time, space, reagents, and wasting part of the sample. If the altered droplets cannot be excluded reliably or interfere with data collection, the altered droplets can introduce errors into assay results, in some cases confounding assay interpretation.

New approaches are needed to maintain droplet integrity during droplet manipulations.

SUMMARY

The present disclosure provides a system, including apparatus and methods, for aspirating at least a portion of an emulsion from a well using a tip. In some embodiments, the tip may have a flat end and an inlet surrounded by the flat end. The well may have a floor with one or more surface features that prevent uninterrupted circumferential contact of the flat end of the tip with any region of the floor. In some embodiments, the tip may not have a flat end. In some embodiments, the well may have a port that guides the tip to the floor with the tip slanted with respect to the floor. Methods of making a device that includes the well are also disclosed.

DETAILED DESCRIPTION

Figure 1:
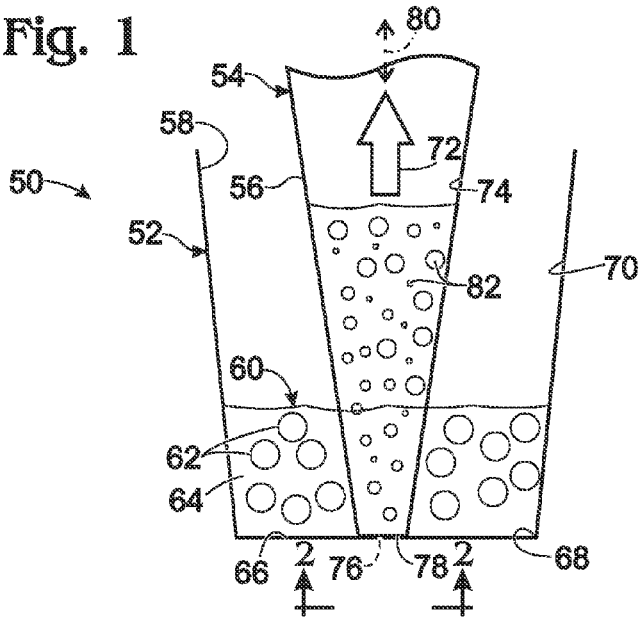
FIG. 1 is a schematic side view of selected aspects of exemplary emulsion aspiration system as an emulsion is being aspirated from a well into a tip (e.g., a pipette tip) of a fluid-aspiration device (e.g., a pipette), under conditions that produce substantial fragmentation ("shredding") of droplets to smaller sizes, in accordance with aspects of the present disclosure.
Figure 2:
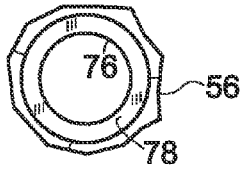
FIG. 2 is a fragmentary bottom view of the tip of FIG. 1 taken generally along line 2-2 of FIG. 1 in the absence of the well.

The present disclosure provides a system, including apparatus and methods, for aspirating at least a portion of an emulsion from a well using a tip. In some embodiments, the tip may have a flat end and an inlet surrounded by the flat end. The well may have a floor with one or more surface features that prevent uninterrupted circumferential contact of the flat end of the tip with the floor. In some embodiments, the tip may not have a flat end. In some embodiments, the well may have a port that guides the tip to the floor with the tip slanted with respect to the floor. Methods of making a device that includes the well are also disclosed.

An exemplary system for aspirating an emulsion is provided. The system may comprise a fluid-aspiration device including a tip having a flat end surrounding an inlet. The system also may comprise a well to hold an emulsion and receive the flat end of the tip. The well may include a floor having one or more surface features that prevent uninterrupted circumferential contact of the flat end of the tip with any region of the floor.

An exemplary device is provided for forming and holding an emulsion to be at least partially aspirated into a tip of a fluid-aspiration device. The tip may have a flat end surrounding an inlet. The device may comprise a droplet generation region configured to form droplets of an emulsion. The device also may comprise a well fluidically connected to the droplet generation region and including a floor having one or more surface features that prevent uninterrupted circumferential contact of the flat end of the tip with any region of the floor.

An exemplary method of emulsion transport is provided. In the method, an emulsion including droplets may be disposed in a well having a floor. A flat end of a tip may be disposed in the well and in contact with the emulsion and the floor. At least a portion of the emulsion may be aspirated into the tip via an inlet thereof that is surrounded by the flat end. The floor may define a plane. Placement of the flat end of the tip against the floor parallel to the plane may form at least one passage for fluid flow under the flat end and into the tip.

An exemplary method of fluid manipulation is provided. In the method, an emulsion may be formed. At least a portion of the emulsion may be disposed in a well having a floor. A flat end of a tip may be disposed in the well. At least a portion of the emulsion may be aspirated into the tip via an inlet of the tip that is surrounded by the flat end. The floor of the well may have one or more surface features that prevent uninterrupted circumferential contact of the flat end of the tip with any region of the floor.

An exemplary device for emulsion production is provided. The device may comprise a droplet generation region configured to form droplets of an emulsion. The device also may comprise a well configured to collect the emulsion and including a floor, a side wall region extending upwardly from the floor, and a guide region disposed over the floor and defining a port configured to guide a tip of a fluid-aspiration device to the floor such that the tip is tilted with respect to the floor.

An exemplary system for emulsion formation and transport is provided. The system may comprise a droplet generation region configured to form an emulsion. The system also may comprise a well configured to collect the emulsion and including a floor, a side wall region extending upwardly from the floor, and a ceiling region disposed above the floor and defining a port. The system further may comprise a fluid-aspiration device equipped with a tip having a bottom end capable of being advanced through the port and into contact with the floor. The port may be configured to orient the tip obliquely with respect to the floor.

An exemplary method of transporting an emulsion is provided. In the method, an emulsion may be disposed in a well having a floor, a side wall region extending upwardly from the floor, and a guide region disposed over the floor and defining a port. A tip of a fluid-aspiration device may be placed into the well via the port such that the tip is oriented obliquely with respect to the floor by the port. At least a portion of the emulsion may be aspirated from the well into the tip while the tip remains obliquely oriented.

An exemplary method of modifying a well is provided. The well may be configured to hold an emulsion to be aspirated with a fluid-aspiration device including a tip having a flat end. In the method, a floor or a prospective floor of a well may be deformed to produce one or more surface features that prevent uninterrupted circumferential contact of the flat end with any region of the floor or prospective floor.

The emulsion formation, collection, and/or aspiration systems disclosed herein may have numerous advantages over other approaches to emulsion formation and transport. These advantages may include any combination of the following: improved droplet integrity, less droplet fragmentation, and less need to train a user about how to position a tip in a well, among others.

Further aspects of the present disclosure are presented in the following sections: (I) strategies for emulsion aspiration from a well, (II) exemplary emulsion aspiration system, and (III) examples.

I. Strategies For Emulsion Aspiration From A Well

This section describes exemplary emulsion aspiration strategies with wells that permit (seal-permissive) or prevent (seal-restrictive) uninterrupted circumferential contact with the flat end of a pipette tip; see FIGS. 1-4.

FIG. 1 shows selected aspects of an exemplary emulsion aspiration system 50 that may produce substantial droplet fragmentation ("shredding") during aspiration of an emulsion. The system may include a fluid-holding device 52 (interchangeably termed a sample holder), such as an emulsion-producing device capable of forming one or more emulsions. The system also may include a fluid-aspiration device 54 having a tip 56 for contact with and intake of at least a portion of an emulsion. (The fluid-aspiration device interchangeably may be termed a fluid-transfer device and/or a fluid transporting device.)

Device 52 includes at least one seal-permissive well 58 capable of holding an emulsion 60 of droplets 62 disposed in a carrier phase 64 (interchangeably termed a continuous phase). The well may be an outlet well (interchangeably termed a collection well) that is operatively disposed to receive and collect emulsion 60 from a droplet generation region of device 52. For example, the outlet well may be fluidically connected to the droplet generation region such that the droplets can flow from the droplet generation region to the outlet well after their formation. The droplets may float, sink, or may have a neutral buoyancy, among others, in the carrier phase.

Well 58 includes a floor 66 having a perimeter 68. The floor may be horizontal and may have a flat smooth surface, rendering the well seal-permissive with tip 56. The perimeter may be circular, elliptical, polygonal, or the like. In some embodiments, floor 66 may be concave.

The well also may have a side wall region 70 extending upwardly from perimeter 68 of the floor. The side wall region may extend around a central vertical axis of the well to restrict lateral flow of fluid from the well. The side wall region may (or may not) taper toward the floor and may have any suitable cross-sectional shape, such as circular, elliptical, polygonal, or the like. Accordingly, the side wall region may be cylindrical, frustoconical, or a combination thereof, among others.

Fluid-aspiration device 54 may be configured to form a pressure drop, indicated by an arrow at 72, that draws fluid into an interior compartment 74 defined by tip 56, from an inlet 76 formed at the bottom end (or distal end) of the tip. (The inlet also may or may not function as an outlet if the emulsion is dispensed from the tip later.) The tip may have a flat end 78 formed by an annular surface region that completely surrounds inlet 76. (Also see the bottom end view of FIG. 2.) Flat end 78 allows uninterrupted circumferential contact with floor 66 when they are parallel to each other, such as when a long axis (or flow axis) 80 of tip 56 is normal to a plane defined by floor 66. The tip may or may not be tapered.

Circumferential contact with the tip may result in a temporary seal that creates a pressure drop (a vacuum) at the end of the tip. Once the pressure drop is formed, its sudden release can result in rapid flow of droplets into the tip, which may exert tensile and/or shear forces (among others) that disrupt droplet integrity. For example, in the present illustration, the size of the droplets changes dramatically and unpredictably during aspiration. Intact droplets 62 present outside tip 56 have a uniform size, but then are transformed to smaller, fragmented droplets 82 present inside the tip. An aspiration system with reduced droplet fragmentation is needed.

Tip 56 may have any suitable dimensions. For example, in an illustrative, non-limiting embodiment, a distal end of the tip may have an outer diameter of about 600-800 μm or about 700 μm, an inner diameter of about 300-700 μm, 400-600 μm, or about 500 μm, and a wall thickness measured radially of about 75-150 μm or about 100 μm.

Figure 3:
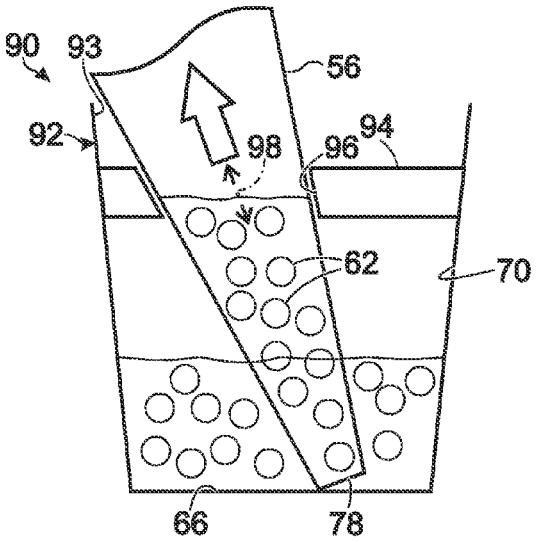
FIG. 3 is a schematic side view of selected aspects of another exemplary emulsion aspiration system, taken as in FIG. 1, but with a port of the well restricting the angle at which the tip can be placed into the well, which substantially improves droplet integrity relative to the system of FIG. 1, in accordance with aspects of present disclosure.

FIG. 3 shows selected aspects of an exemplary emulsion aspiration system 90 that can reduce the amount of droplet fragmentation during aspiration of an emulsion, relative to system 50 of FIG. 1. System 90 may be structured generally like system 50 described above (and may have any combination of the features of system 50), except that system 90 has an emulsion holding/producing device 92 including a seal-resistant well 93 with a guide region 94. The guide region may provide a physical barrier that guides the tip into the well along an oblique path and that forces the pipette tip to be tilted with respect to the floor, such that the floor cannot achieve uninterrupted circumferential contact with flat end 78 of the tip around inlet 76 (also see FIG. 2). The long axis of the tip may form any suitable angle with the floor to prevent circumferential contact, such as less than 90, 85, 80, 70, or 60 degrees, among others.

Guide region 94 may have any suitable properties. The guide region may be disposed above floor 66 and may project radially inward from side wall region 70. The guide region may function as a guide that defines an oblique orientation for tip 56 with respect to floor 66. The guide region may define a path for longitudinal advancement of the tip, while acting as a barrier to lateral tip motion. For example, the guide region may define a port 96 sized to receive a portion of the tip. The port may be an opening, such as a through-hole, defined at least in part by the guide region. The port may permit the tip to be advanced into contact with floor 66, as shown in FIG. 3.

The port may define a receiving axis 98 for tip 56, with the receiving axis oriented obliquely to a plane defined by floor 66, such as arranged at an angle of about 50-85, 60-80, or 70 degrees with respect to the floor. The angle chosen may balance competing considerations: an angle closer to 90 degrees minimizes the residual volume of emulsion that cannot be aspirated into the tip, while a smaller angle minimizes the chance of forming a temporary seal. Restricting the angle at which the tip can be received in the well, to prevent the tip from forming a seal with the floor, can substantially improve droplet integrity relative to the system of FIG. 1, as illustrated by intact droplets 62 disposed inside tip 56.

Figure 4:
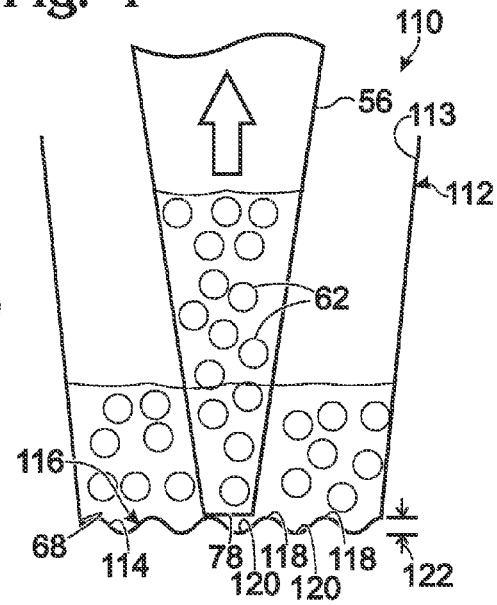
FIG. 4 is a schematic side view of selected aspects of yet another exemplary emulsion aspiration system, taken as in FIG. 1, but with the well having a floor with surface features that prevent circumferential contact of the end of the tip with the floor, which substantially improves droplet integrity relative to the system of FIG. 1, in accordance with aspects of the present disclosure.

FIG. 4 shows selected aspects of another exemplary emulsion aspiration system 110 that can reduce the amount of droplet fragmentation during aspiration of an emulsion, relative to system 50 of FIG. 1. System 110 may be structured generally like system 50 described above (and may have any combination of the features of system 50), except that the system has a different emulsion holding/producing device 112. The device has a seal-resistant well 113 with a floor 114 having a variable elevation as the floor extends between spaced positions of the floor's perimeter. The variable elevation forms one or more surface features 116 that prevent tip 56 from circumferential contact with the floor and thus formation of a seal. The surface features create a gap between the flat end of the tip and the floor, which results in a higher percentage of intact droplets 62 inside tip 56.

The floor may have any suitable surface features 116 formed by the variable elevation. In particular, the elevation of the floor may increase and then decrease (or vice versa) at least once or a plurality of times in succession on a path between opposite sides of the well. Accordingly, the elevation may alternately increase and decrease a plurality of times to form a plurality of projections 118 and/or recesses 120. The projections/recesses each may have the same height or depth 122 as shown, or the height/depth may vary among the projections/recesses. The projections may be ridges, knobs, bumps, spikes, or the like. The recesses may be grooves, dimples, or the like. In some embodiments, the elevation of the floor may vary along each of a pair of orthogonal horizontal axes. In some embodiments, the floor may define a plurality of ridges that each extend continuously between a pair of spaced positions near opposite sides of the floor's perimeter. In some embodiments, the floor may define a grid pattern of projections and/or recesses. In any event, the surface features may be defined by the floor such that one or more passages (interchangeably termed gaps or openings) are formed collectively by the end of the tip and the floor of the well, which allow the passage of fluid, even with the pipette tip pressed against the floor and oriented normally to the floor.

Surface features 116 defined by the floor may have any suitable dimensions. For example, at least one of the surface features may have a height or depth (measured with respect to an adjacent region of the floor) that is at least about one-fourth, at least about one-half, or at least about as great as the average diameter of the droplets. In some embodiments, the height or depth may be greater than about 2, 5, 10, 25, or 100 times the average diameter of the droplets. The average diameter of the droplets may, for example, be less than, greater than, or about 1, 2, 5, 10, 25, 50, 100, 200, or 500 μm, among others. The height or depth of at least one of the surface features may, for example, be at least about 1, 2, 5, 10, 20, 50, 100, 200, or 500 μm, among others. The floor may vary in elevation by at least about one-fourth, at least about one-half, or at least about the average diameter of droplets 62. Also, the average distance between projections and/or recesses defined by the floor may be less than (e.g., less than about one-half) the diameter of inlet 76 of tip 56 (also see FIGS. 1 and 2). In exemplary embodiments, the diameter of inlet 76 (i.e., the inner diameter of tip 56 at end 78) may be sized as described above.

II. Exemplary Emulsion Aspiration System

Figure 5:
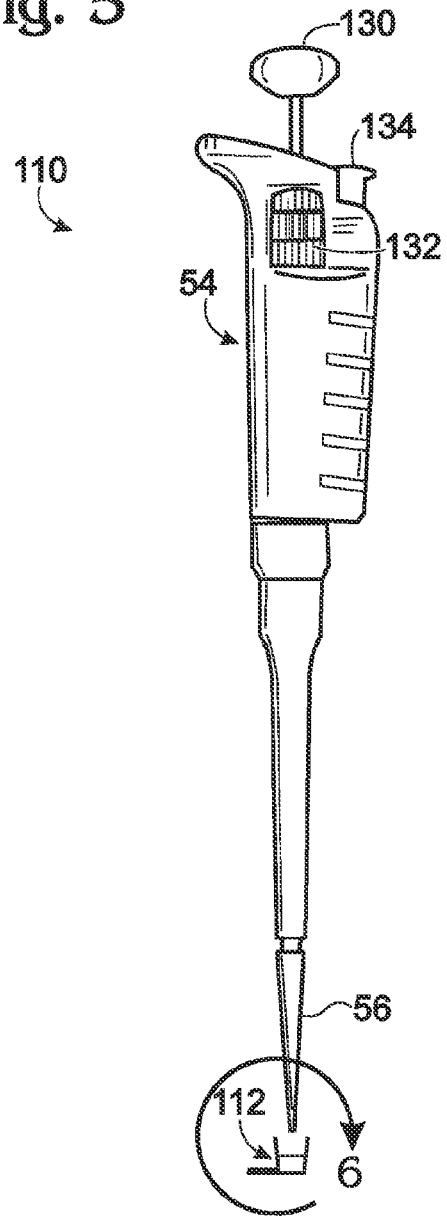
FIG. 5 is a partially schematic side view of selected aspects of the emulsion aspiration system of FIG. 4.
Figure 6:
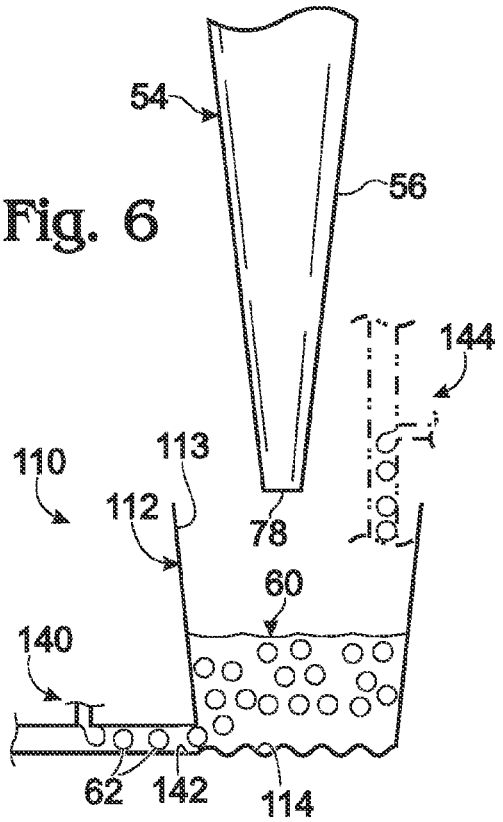
FIG. 6 is another partially schematic view of the emulsion aspiration system of FIG. 4, taken generally at the region indicated at "6" in FIG. 5.

This section describes further aspects of emulsion aspiration system 110; see FIGS. 4-6. Features of system 110 may be combined with any suitable elements or features of systems 50 and/or 90 (see FIGS. 1-3) and/or with the devices or systems described elsewhere in the present disclosure.

FIG. 5 shows fluid-aspiration device 54 with tip 56 above and spaced from emulsion 60, while the emulsion is being formed. In some cases, during emulsion formation, the outlet well(s) of device 112 may be covered, such that the tip cannot be placed into the outlet well until emulsion formation is complete.

Fluid-aspiration device 54 may be any device that is operable to draw fluid from a well and into a tip. The fluid-aspiration device may be equipped with a tip 56 that is removable, or the tip may be attached permanently and/or integral. The fluid-aspiration device may be operable to urge any suitable volume of fluid into tip 56, such as at least about 1, 5, 10, 50, or 100 μL, among others. Device 54 may have an actuator 130 that can be manipulated to drive fluid flow. The device may be powered manually or via a power source, such as a battery or line power, among others. The device also may have a volume control 132 to adjust the volume aspirated into and/or dispensed from the tip, and an ejection control 134 operable to eject tip 56 after use. In exemplary embodiments, fluid-aspiration device 54 is a pipette, such as a Bio-Rad Professional® adjustable-volume 20-200 μL digital micropipette or a Rainin® P200 brand pipette. In some embodiments, the fluid-aspiration device may be a multipipettor capable of being equipped with a plurality of tips for aspiration of emulsions from a plurality of wells (e.g., in parallel).

FIG. 6 shows additional features of emulsion-producing device 112. Well 113 may be fluidically connected to a droplet generation region 140 of device 112. More particularly, well 113 may be arranged with respect to the droplet generation region such that droplets 62 and/or emulsion 60, formed by at least one droplet generator of region 140, can travel within the device to well 113 for collection therein. For example, droplet generation region 140 may be fluidically connected to well 113 by at least one channel 142 disposed downstream of droplet generation region 140 and upstream of well 113. Droplet generation region 140 and well 113 both may be integral to device 112, such that neither can be removed from the device without damaging or breaking the device. In some embodiments, droplets 62 may be supplied to well 113 by a removable droplet generator device 144, which is shown here in phantom outline. The removable droplet generator device may be operatively disposed to feed formed droplets to the well during or after droplet formation, and then may be removed after droplet formation. Further aspects of integral and removable droplet generators that may be suitable are described in the patent documents listed above under Cross-References, which are incorporated herein by reference, particularly U.S. Patent Application Publication No. 2012/0152369 A1, published Jun. 21, 2012; and U.S. Patent Application Publication No. 2012/0190032 A1, published Jul. 26, 2012.

III. Examples

This section describes selected aspects and embodiments of the present disclosure related to exemplary emulsion aspiration systems, and methods of making and using the systems. These examples are intended for illustration only and should not limit or define the entire scope of the present disclosure.

Example 1

Exemplary Well with a Patterned Floor

Figure 7:
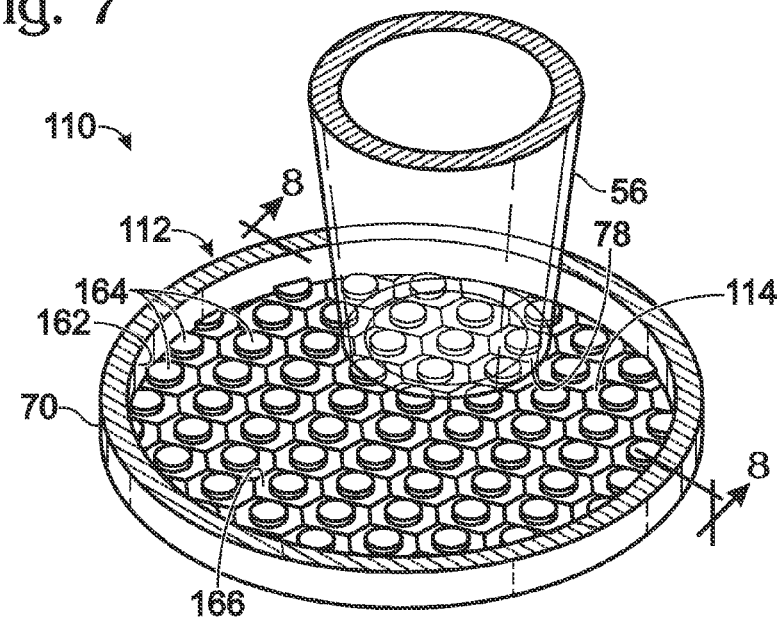
FIG. 7 is a fragmentary horizontal sectional view of a well having a floor defining a plurality of protrusions, with a flat end of a pipette tip disposed against and parallel to the floor, in accordance with aspects of the present disclosure.
Figure 8:
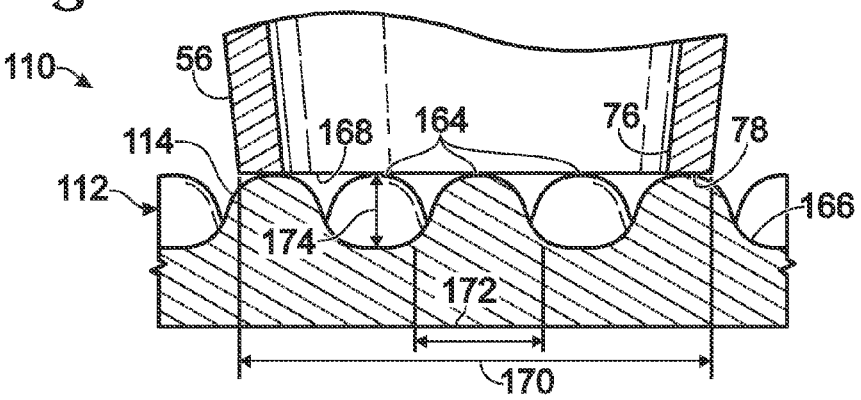
FIG. 8 is a fragmentary sectional view of the well and tip of FIG. 7, taken generally along line 8-8 of FIG. 7.

This example describes a well embodiment 162 having a floor 114 defining a two-dimensional array of protrusions 164 as surface features 116; see FIGS. 7 and 8 (also see FIG. 4).

FIGS. 7 and 8 show flat end 78 of tip 56 in contact with floor 114 and arranged parallel to a plane defined by the floor. Rows of protrusions 164 may be arranged along a pair of transverse axes and may be described as bumps. The protrusions project from a lower portion 166 of the floor. Flat end 78 of tip 56 is elevated from lower portion 166 by contact with protrusions 164, which creates one or more passages or gaps 168 where fluid including droplets can pass under flat end 78 to reach tip inlet 76 (see FIG. 8). In other words, each passage 168 provides fluid communication between regions of the well outside the tip and the inside of the tip. Passage 168 restricts the ability of the tip to form a seal with floor 114.

FIG. 8 shows exemplary dimensional relationships between tip 56 and protrusions 164. Tip 56 may have an outer diameter 170 at end 78 that is substantially greater than a diameter or width 172 of each protrusion 164. For example, outer diameter 170 (and/the inner diameter) may be at least about two or three times as large as protrusion diameter 172. Also, protrusions 164 (and/or passages 168) may have an average height 174 that is substantially less than outer diameter 170 (and/or the inner diameter) of flat end 78, such as less than about one-half of diameter 170.

Example 2

Exemplary Tip with a Wavy End

Figure 9:
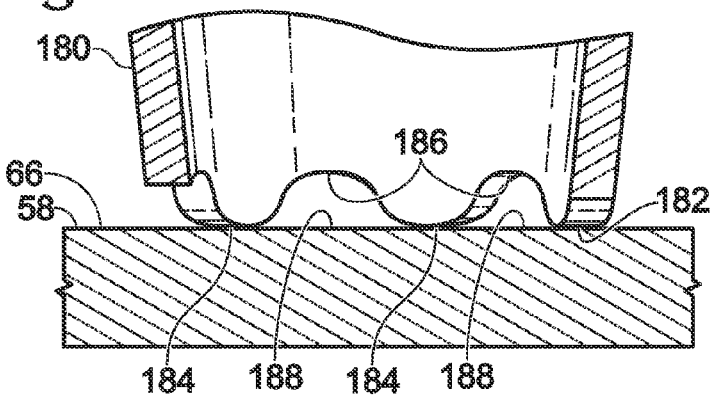
FIG. 9 is a fragmentary sectional view of a well having a flat floor that is in contact with the bottom end of a tip, where the bottom end is not flat, taken generally as in FIG. 8.

This example describes a tip 180 having an end 182 that is not flat; see FIG. 9.

FIG. 9 shows tip 180 abutted with well 58 (see FIG. 1), which has a floor 66 lacking any surface features. Floor 66 may be flat, as shown, or concave, among others. In any event, tip 180 has a nonplanar end 182 defining one or more projections 184 and/or one or more recesses 186. When tip 180 is placed against floor 66 with the tip normal to the floor, as shown, one or more passages 188 for fluid flow into the tip are defined collectively by the tip and the floor. Each surface feature and passage may have any of the dimensions described above for surface features and passages of other embodiments. In some examples, neither the end of the tip nor the floor of the well is flat.

Example 3

Exemplary Tool for Forming Surface Features

Figure 10:
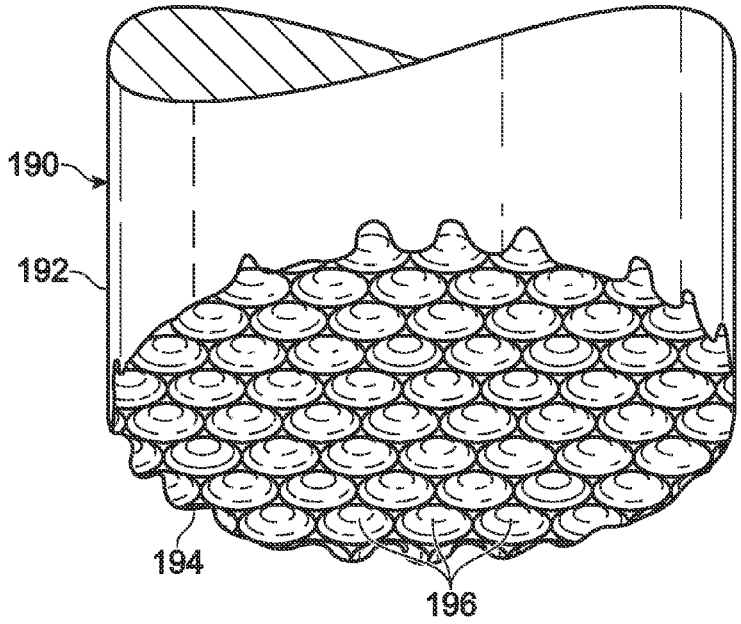
FIG. 10 is a fragmentary view of an end region of an exemplary stamping tool for creating a pattern of surface features on a floor of a well for holding an emulsion, in accordance with aspects of the present disclosure.

This example describes an exemplary stamping tool 190 (interchangeably termed a deforming tool or a forming tool); see FIG. 10. The tool may be utilized to add surface topography to a floor of a well of an emulsion-producing and/or emulsion-holding device (e.g., see floor 114 of FIGS. 7 and 8).

Tool 190 may have a cylindrical shaft or body 192 with a working end having an end surface 194 defining one or more recesses and/or one or more projections. The end surface may be patterned with a one-dimensional or two-dimensional array of surface features. Here, the end surface defines a two-dimensional array of recesses 196. The recesses (and/or projections) can produce complementary or matching surface features on the floor of a well, depending on whether the tool directly contacts the floor or contacts a surface region under and opposite the floor (or prospective floor).

The working end of the tool, and particularly end surface 194, may have any suitable dimensional relationship with the floor of the well. If used inside a well, the end of the tool may have a diameter that at least slightly less than the diameter of the floor (to minimize or avoid contact of the tool with the side wall region of the well), but large enough to contact a majority of the floor area (e.g., greater than about 50%, 60%, 75%, or 90% of the area, among others, of the floor area).

The recesses and/or projections may be arranged regularly in two or more rows, which may form rows and columns. The rows may be parallel to one another, the columns may be parallel to one another, and the rows may or may not be orthogonal to the columns. Here, the recesses have a uniform size, shape, and depth. However, in other embodiments, the recesses (or projections) may vary in size, shape, and/or depth.

Any of the tools disclosed herein may form surface features on a floor of a well (or on a prospective floor of a prospective well) at any suitable time and in any suitable manner. The tool may be disposed in pressing engagement with the floor and/or a base (or a prospective floor and/or a prospective base) of the well from above the floor/base (e.g., with the working end of the tool disposed in the well). Alternatively, the tool may be disposed in pressing engagement with a bottom surface region of the base that is disposed under and opposite the floor (i.e., with the working end of the tool disposed outside the well).

In some cases, surface features may be formed by the tool on a prospective floor of the well before and/or as the well is created. In particular, a lower member (e.g., a sheet) of the emulsion holding/producing device, which will form the floor/base, may be deformed before (or as) the lower member has been (and/or is being) attached to a side wall region of the well provided by an upper member (see Example 4 for exemplary upper and lower members). In any event, the tool may or may not contact the floor or prospective floor itself during modification of the floor's surface topography.

Deformation of the floor by the tool may be encouraged any suitable conditions. For example, deformation may be facilitated by pressure (exerted by the tool on the base/floor and/or by the base/floor on the tool), heat (e.g., by heating the tool and/or the base, such as to about 80° C. to 150° C. or about 120° C.), the presence of a solvent, or any combination thereof, among others. In some cases, deformation of the floor or prospective floor may be performed below 30° C. (e.g., at room temperature).

The tool may stamp each well, floor, or prospective floor only once or two or more times. If the tool stamps the floor/prospective floor more than once, the tool may have a different position each time the tool stamps the well (e.g., rotated a fraction of a turn about the long axis of the tool).

In some embodiments, the tool may have a plurality of stamping members configured to stamp a plurality of wells, floors, or prospective wells/floors, in parallel (e.g., to stamp wells/floors of the same device). The stamping members may, for example, be copies of the working end of tool 190 arranged in an array.

The surface topography of the floor of each well may be created by any other suitable approach(es). For example, surface features of the floor of the well may be created by molding, machining, grit blasting, sanding, material deposition, or any combination thereof.

Example 4

Exemplary Emulsion-Production Devices

This example describes exemplary emulsion-production devices each having a plurality of integral emulsion production units, with each unit including a seal-resistant outlet well; see FIGS. 11-16.

Figure 11:
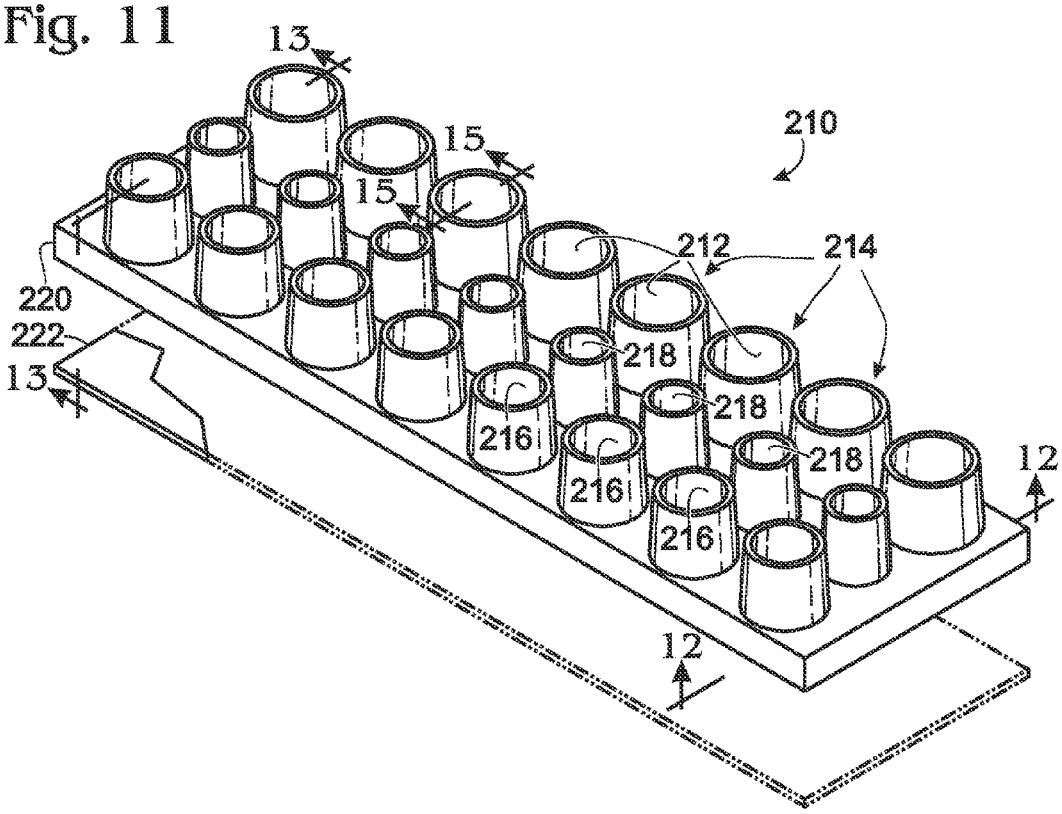
FIG. 11 is an exploded view of an exemplary emulsion-production device having a plurality of outlet wells for collecting emulsions formed by the device, in accordance with aspects of the present disclosure.

FIG. 11 shows an exemplary emulsion-production device 210 having a plurality of outlet wells 212 for holding emulsions formed by respective droplet generation regions of the device. Each outlet well 212 is part of a distinct emulsion production unit 214 composed of a row of inlet wells 216 and 218 and an outlet well 212, with the row of wells fluidically interconnected by channels (see below). Accordingly, the depicted embodiment has eight emulsion production units 214. However, the device may have any suitable number of emulsion production units.

Device 210 may be composed of an upper member 220 and a lower member 222 that is attached to a bottom side of the upper member. The upper member may form the side walls of the wells. The lower member may form the base of each well. More particularly, the lower member may have a top surface that forms the floors of the wells and a bottom surface that faces away from the wells. The lower member may be a sheet, such as a film.

Figure 12:
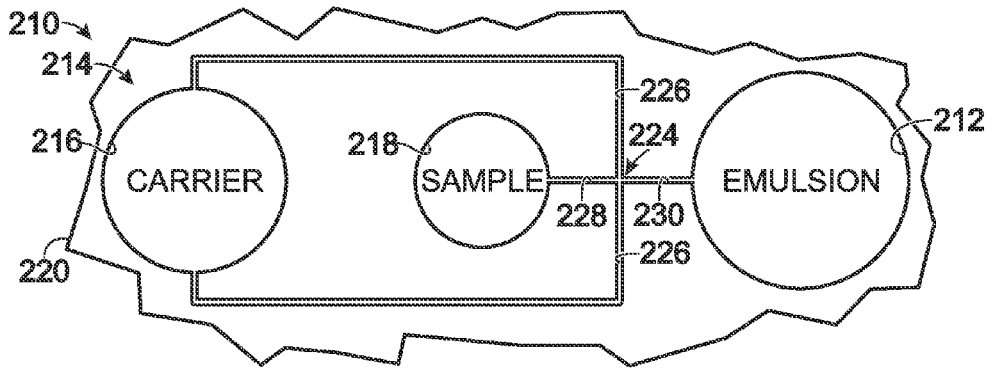
FIG. 12 is a fragmentary bottom view an upper member of the device of FIG. 11, taken generally along line 12-12 of FIG. 11 toward an emulsion production unit of the device, with the emulsion production unit including one of the outlet wells for collecting an emulsion.

FIG. 12 shows a somewhat schematic view of an emulsion production unit 214 of the device. Unit 214 may include a carrier well 216 (an inlet well) that holds a carrier fluid (a prospective continuous phase) for an emulsion to be formed. The unit also may include a sample well 218 (another inlet well) that holds a sample (or other prospective dispersed phase), such as an aqueous sample, for the emulsion to be formed. One or more channels may extend from each of wells 216 and 218 to droplet generation region 224. Here, a pair of carrier input channels 226 extend from well 216 to droplet generation region 224, and a single sample input channel 228 extends from well 218. An output channel 230 extends from droplet generation region 224 to outlet well 212.

Figure 13:
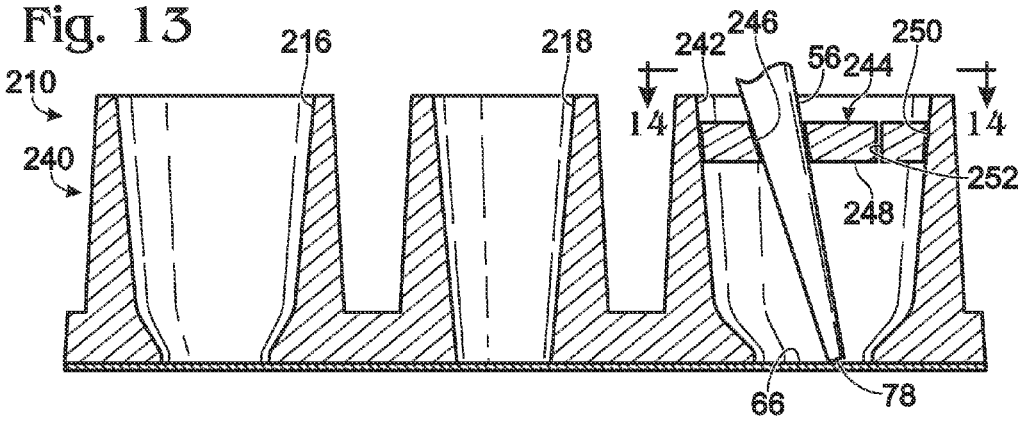
FIG. 13 is a cross-sectional view of an embodiment of the device of FIG. 11 that has a port to orient a pipette tip obliquely, with the view taken generally along line 13-13 of FIG. 11 through an emulsion production unit and in the presence of a pipette tip, in accordance with aspects of the present disclosure.
Figure 14:
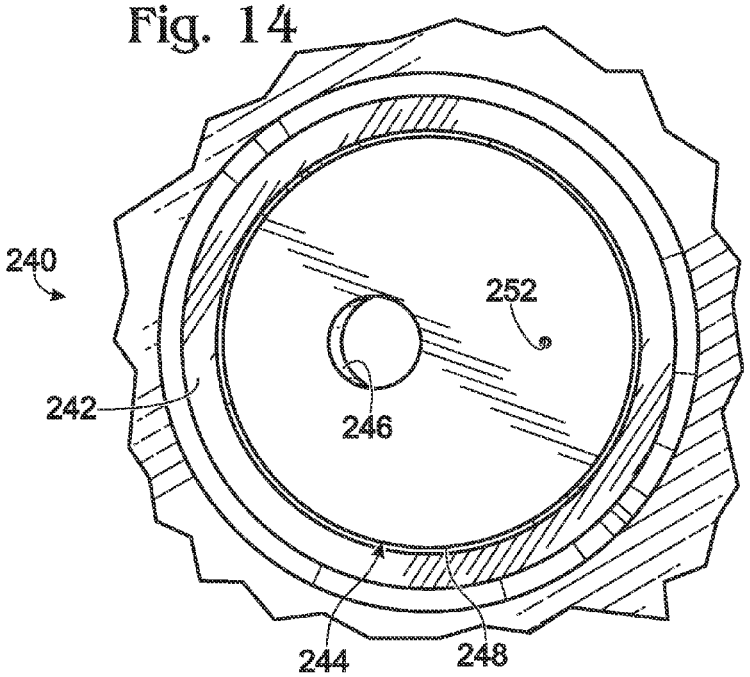
FIG. 14 is a fragmentary top view of the embodiment of FIG. 13, taken generally along line 14-14 of FIG. 13.

FIGS. 13 and 14 show an exemplary embodiment 240 of device 210 of FIG. 11 with a tip 56 disposed in an embodiment 242 of outlet well 212. Well 242 may have any combination of features disclosed elsewhere herein, such as for well 93 of FIG. 3. Tip 56 may be guided into the well at an oblique angle by a guide region 244 of the well formed by an upper portion of the well. The guide region, which may be a ceiling region, may define an opening or port 246 through which the lower end portion of the tip travels. The ceiling region may be a ceiling member provided by a disc 248 (e.g., formed of plastic) that is sized to fit into the well, namely, with a side wall region 250 of the well surrounding the disc. The disc may be disposed near the top of the side wall region.

Disc 248 may define any suitable number of openings alone or in combination with the side wall region of the well. Port 246 may be a bore oriented obliquely to floor 66, and may guide travel of the tip to the bottom of the well and restrict reorientation of the tip to a normal (vertical) orientation thereafter. The size of port 246 may correspond to the outer diameter of the pipette tip at a position adjacent the disc, with the tip advanced to the bottom of the well. Disc 248 also may define a vent 252 that allows air to move in and out of well 242 freely, to maintain the well at atmospheric pressure as fluid is added to and/or removed from the well. Disc 248 can be a separate piece from side wall region 250. If a separate piece, the disc can be attached with an adhesive, solvent bonding, a press fit, one or more mechanical fasteners, or the like. Alternatively, the guide region of the well can be formed integrally with the side wall region of the well. In some embodiments, the guide region may formed by a cap that is placed onto the well over the top of the side wall region.

Figure 15:
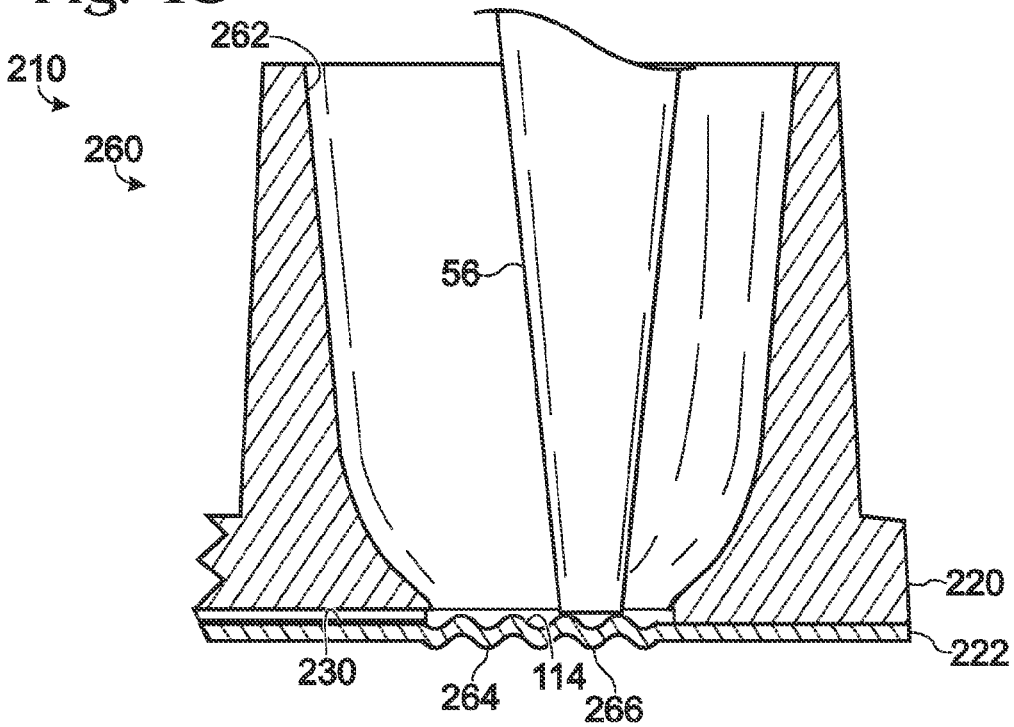
FIG. 15 is a fragmentary cross-sectional view of an embodiment of the device of FIG. 11 that has an outlet well with a floor defining a plurality of surface features to restrict uninterrupted circumferential contact with the flat end of a tip, with the view taken generally along line 15-15 of FIG. 11, and with a tip extending vertically into the well and in contact with the floor, in accordance with aspects of the present disclosure.

FIG. 15 shows another exemplary embodiment 260 of device 210 of FIG. 11 with a tip 56 disposed in another embodiment 262 of outlet well 212. Well 262 may have any combination of features disclosed elsewhere herein, such as for well 113 of FIG. 4. Lower member 222 forms a base 264 of well 262. The base has a top surface region that forms floor 114 and a bottom surface region 266 disposed under and opposite the floor. The bottom surface region, like floor 114, may have surface features and/or a variable elevation. For example, here, bottom surface region 266 defines a plurality of recesses and projections where the elevation of the bottom surface region increases and decreases. In some cases, changes in elevation of floor 114 and bottom surface region 266 may occur at substantially corresponding positions. In other words, upward projections (if any) defined by floor 114 may be disposed over and substantially aligned with recesses (if any) defined by bottom surface region 266, and recesses (if any) defined by floor 114 may be disposed over and aligned with downward projections (if any) defined by bottom surface region 266. More generally, the floor may be complementary to the bottom surface region, with each surface feature of the floor having a complementary counterpart defined by bottom surface region 266.

Figure 16:
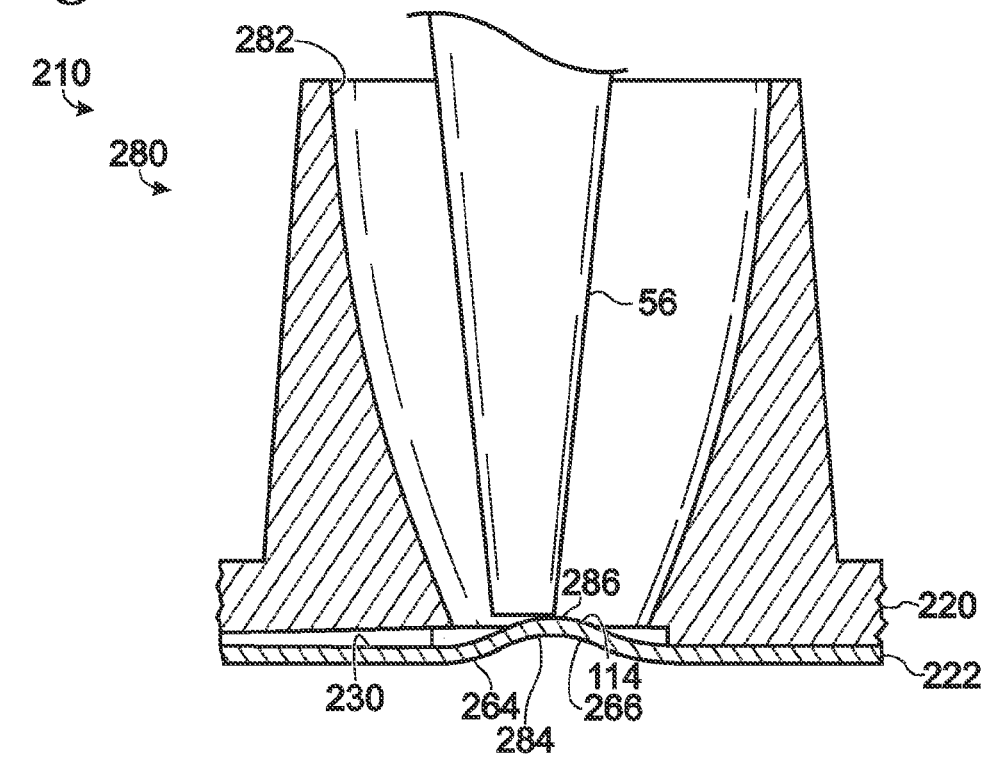
FIG. 16 is a fragmentary cross-sectional view of another embodiment of the device of FIG. 11 that has an outlet well having a floor defining at least one surface feature to restrict uninterrupted circumferential contact with the flat end of a tip, with the view taken as in FIG. 15, and with a tip extending vertically into the well and in contact with the floor, in accordance with aspects of the present disclosure.

FIG. 16 shows another exemplary embodiment 280 of device 210 of FIG. 11 with a tip 56 disposed in another embodiment 282 of outlet well 212. Well 282 may have any combination of features disclosed elsewhere herein, such as for well 113 of FIG. 4. Here, base 264, provided by lower member 222, has a recess or dimple 284 defined by bottom surface region 266, and a corresponding projection or hump 286 defined by floor 114. In other embodiments, base 264 may define a plurality of dimples (e.g., 2, 3, 4, or more) on bottom surface region 266, with corresponding protrusions defined by the floor. Each protrusion may be created by urging base 264 toward the upper region of the well with a tool, from a position below the base. Accordingly, the recess may be created by cold working lower member 222 after the lower member has been attached to upper member 220. The specific geometries used in the device can enhance the quality of droplet pickup. Particularly, the embodiments involving bumps/dimples (or other surface features) patterned on the base of the outlet well enables the user to press a pipette tip into the outlet well at any angle and still be assured that there will be no sealing of the pipette to the floor of the well.

Figure 17:
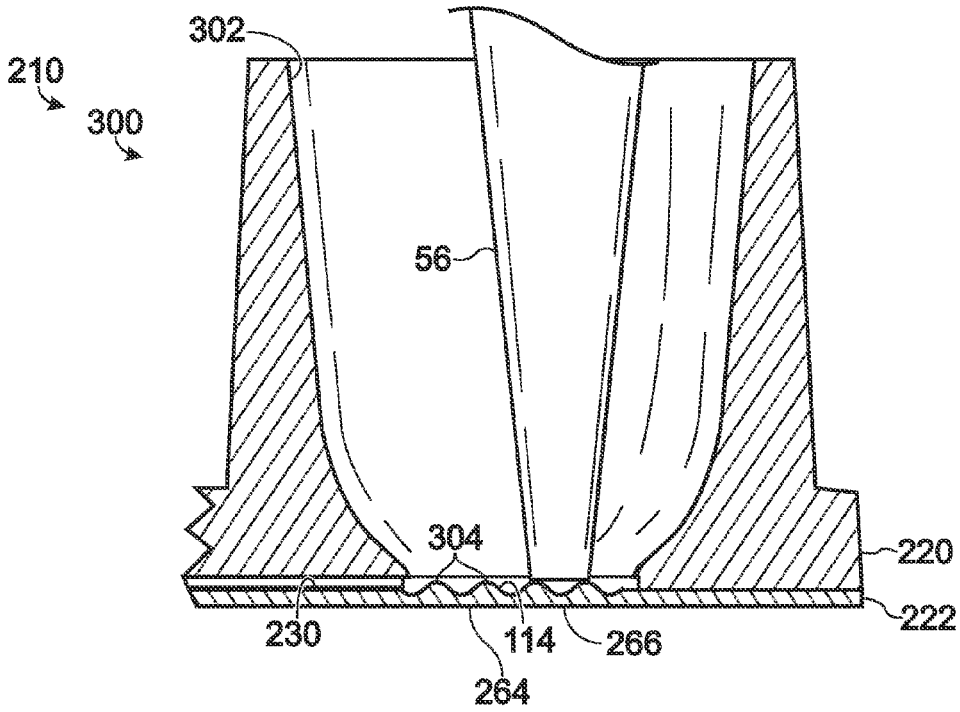
FIG. 17 is a fragmentary cross-sectional view of yet another embodiment of the device of FIG. 11 that has an outlet well having a floor defining a plurality of surface features to restrict uninterrupted circumferential contact with the flat end of a tip, with the view taken as in FIG. 15, and with a tip extending vertically into the well and in contact with the floor, in accordance with aspects of the present disclosure.

FIG. 17 shows another exemplary embodiment 300 of device 210 of FIG. 11 with a tip 56 disposed in another embodiment 302 of outlet well 212. Well 302 may have any combination of features disclosed elsewhere herein, such as for well 113 of FIG. 4. Here, base 264, provided by lower member 222, has a flat bottom surface region 266, and a plurality of projections 304 defined by floor 114. The surface features of floor 114 may be formed by deforming the floor while the bottom surface is abutted with a flat support, or by molding or machining the surface features, among others.

Example 5

Test of Distinct Floor Patterns

This example describes (a) an exemplary stamping tool 320 having a series of ridges 322 extending parallel to one another across a working end of the tool, (b) generation of distinct floor patterns with tool 320, and (c) data obtained by measuring droplet size after aspirating droplets from wells having the distinct floor patterns; see FIGS. 18-23.

Figure 18:
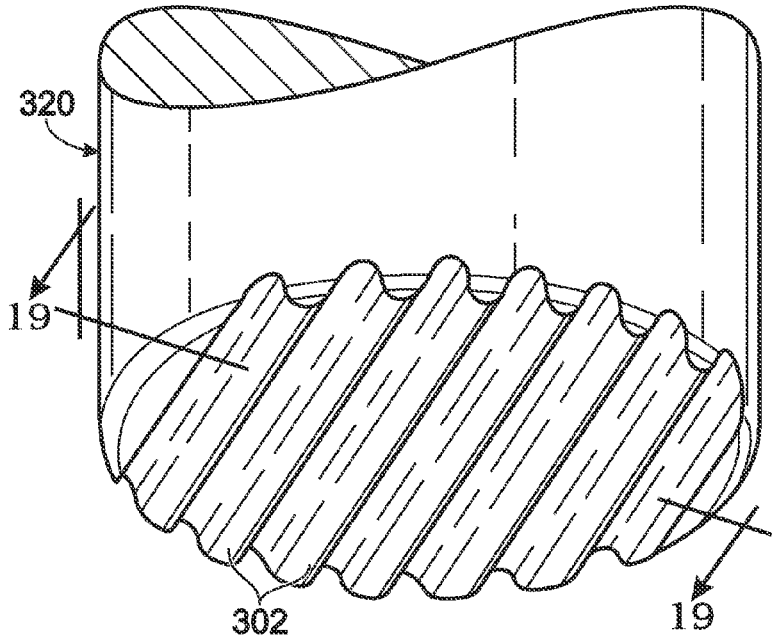
FIG. 18 is a fragmentary view of an end region of another exemplary tool for patterning the floor of a well for holding an emulsion, in accordance with aspects of the present disclosure.

FIG. 18 shows a fragmentary view of the distal portion of a tool 320. The tool may have any combination of features described elsewhere herein, such as for tool 190 of FIG. 10. Ridges 322 may be parallel to one another and orthogonal to the long axis of the tool. The ridges are capable of deforming a flat bottom of a well to form a complementary set of grooves defined by the floor of the well.

Figure 19:
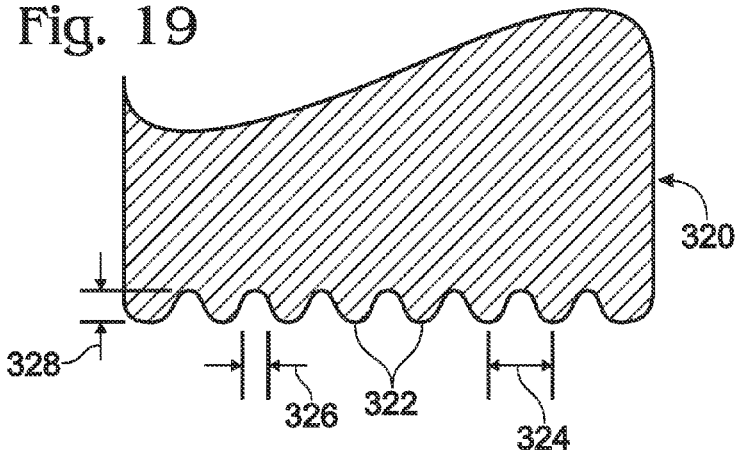
FIG. 19 is a fragmentary sectional view of the tool of FIG. 18, taken generally along line 19-19 of FIG. 18.

FIG. 19 shows exemplary dimensions for ridges 322 and grooves of tool 320. In an exemplary embodiment, intended for illustration only, the ridges have a crest-to-crest spacing 324 of about 250 μm, a groove width 326, measured at one-half of the ridge height, of about 100 μm, and a ridge height 328 of about 120 μm.

Figure 20:
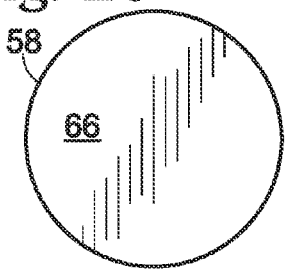
FIG. 20 is a plan view of only the flat, unpatterned floor of a well, with the well having no surface features.

FIG. 20 shows a plan view of only the flat, unpatterned floor 66 of a well 58, with the floor having no surface features.

Figure 21:
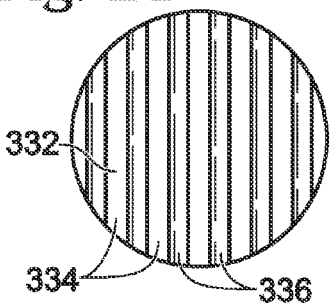
FIG. 21 is a plan view of the floor of FIG. 20 after the floor has been deformed with the tool of FIG. 18 to create a series of ridges and grooves, in accordance with aspects of the present disclosure.

FIG. 21 shows a plan view of a floor 332 produced from floor 66 of FIG. 20 by deforming floor 66 with tool 320 of FIG. 19 to create a series of ridges 334 and grooves 336.

Figure 22:
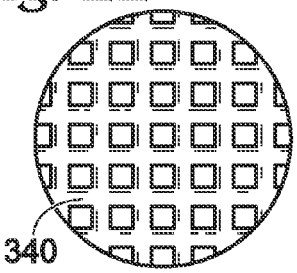
FIG. 22 is a plan view of the floor of FIG. 20 after the floor has been deformed twice with the tool of FIG. 18 at orientations of the tool that are 90 degrees from each other to create a grid pattern, in accordance with aspects of the present disclosure.

FIG. 22 shows a plan view of a floor 340 produced from floor 66 of FIG. 20 by deforming floor 66 with tool 320 of FIG. 19 twice, with the tool at orientations that are 90 degrees from each other to create a grid pattern of intersecting grooves.

Figure 23:
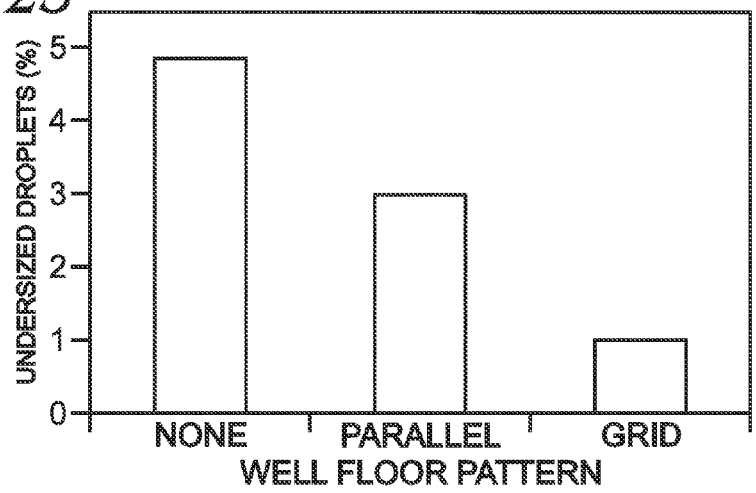
FIG. 23 is a graph of data obtained by measuring droplet size after pipetting emulsions from sets of wells having the three floor configurations of FIGS. 20-22, with average percentages of undersized droplets plotted as a function of the floor pattern of each set of wells.

FIG. 23 shows a graph of data obtained by analyzing droplet size after pipetting emulsions from sets of wells having the three floor configurations of FIGS. 20-22, with average percentages of undersized droplets plotted as a function of well floor type. The data were obtained from three sets of wells with each set representing 48 wells having one of the three floor types shown in FIGS. 20-22. (The patterns for the floors of FIGS. 20-22 are identified as "none," "parallel," and "grid," respectively in FIG. 23.) Fluorescence intensity was measured with a detector for droplets aspirated from each well. Droplet fragmentation was visible as droplet fluorescence of lower intensity ("negative rain"), produced by undersized droplets. Wells having a floor with a grid pattern performed the best, with the least droplet fragmentation, while wells having an unmodified (and non-patterned) floor performed the worst, with the most droplet fragmentation.

Example 6

Selected Embodiments I

This example presents selected embodiments of the present disclosure related to systems for forming, collecting, and/or aspirating an emulsion. The selected embodiments are presented as a series of numbered paragraphs.

1. A device for emulsion production, comprising: (A) a droplet generation region configured to form an emulsion; and (B) a well configured to collect the emulsion and having a floor facing upward and a side wall region extending upward from the floor, the floor being shaped such that the floor defines a projection.

2. The device of paragraph 1, wherein the floor has a perimeter, and wherein the elevation of the floor alternately increases and decreases a plurality of times as the floor extends along the axis.

3. The device of paragraph 1 or 2, wherein the floor defines a plurality of projections.

4. The device of any of paragraphs 1 to 3, wherein the floor defines at least one recess.

5. The device of paragraph 4, wherein the floor defines a plurality of recesses.

6. The device of any of paragraphs 1 to 5, wherein the projection is a ridge.

7. The device of paragraph 6, wherein the floor defines a plurality of ridges.

8. The device of paragraph 7, wherein the ridges are parallel to one another.

9. The device of paragraph 8, wherein the ridges have a uniform spacing and height.

10. The device of paragraph 7, wherein the ridges intersect to form a grid pattern.

11. The device of paragraph 1, wherein the floor is dimpled.

12. The device of paragraph 1, wherein the floor defines one or a plurality of bumps.

13. The device of any of paragraphs 1 to 12, wherein the well includes a base having a top surface region forming the floor and a bottom surface region disposed under the floor, and wherein the bottom surface region varies in elevation under the floor.

14. The device of paragraph 13, wherein the bottom surface region defines least one recess under the floor.

15. The device of paragraph 13 or 14, wherein the bottom surface region defines a recess under the projection.

16. The device of any of paragraphs 13 to 15, wherein the elevation of the floor varies in at least general correspondence with the elevation of the bottom surface region.

17. The device of any of paragraphs 13 to 16, wherein the floor defines a recess and the bottom surface region defines a projection disposed under the recess.

18. The device of any of paragraphs 1 to 17, wherein the floor is formed by a film.

19. The device of paragraph 18, wherein the side wall region is formed by an upper member attached to a top surface of the film.

20. The device of any of paragraphs 1 to 19, wherein the droplet generation region has a fixed relation to the well.

21. The device of any of paragraphs 1 to 19, wherein the droplet generation region is removably connected to the well.

22. The device of paragraph 1, wherein the droplet generation region and the well are both integral to a same article.

23. The device of paragraph 22, wherein the article includes a plurality of wells each having a floor defining a projection and each configured to collect an emulsion formed by a distinct droplet generation region.

24. The device of any of paragraphs 1 to 23, wherein the side wall region is smoother than the floor.

25. The device of any of paragraphs 1 to 24, wherein the floor has a texture produced by a patterned surface region.

26. The device of any of paragraphs 1 to 25, wherein the floor is horizontal and generally planar.

27. The device of any of paragraphs 1 to 26, further comprising an emulsion disposed in the well.

28. The device of any of paragraphs 1 to 27, wherein the droplet generation region is configured to form droplets having an average diameter of greater than about 1 μm, 10 μm, or 50 μm, and wherein the floor has an elevation that varies by at least about one-fourth the average diameter.

29. The device of paragraph 28, wherein the floor has an elevation that varies by at least about one-half the average diameter.

30. The device of any of paragraphs 1 to 29, wherein the droplet generation region defines an orifice at which droplets are generated, wherein the orifice has a transverse dimension, and wherein an elevation of the floor varies by at least about one-half the transverse dimension.

31. A system for emulsion aspiration, comprising: (A) a droplet generation region configured to form an emulsion; (B) a well configured to collect the emulsion and including a floor facing upward and a side wall region extending upward from the floor, the floor defining a projection; (C) an emulsion disposed in the well; and (D) a fluid-aspiration device including a tip capable of being disposed in the well for aspiration of the emulsion.

32. The system of paragraph 31, wherein the tip has an annular surface region at a distal boundary of the tip, and wherein the tip forms a gap with the floor if the annular surface region is disposed against an area of the floor with the annular surface region parallel to a plane defined by the floor.

33. The system of paragraph 32, wherein the floor is configured to form a gap with the tip at each position where the annular surface region can be placed against the floor with the annular surface region parallel to a plane defined by the floor.

34. The system of paragraph 31, wherein the tip has an annular surface region at a distal boundary of the tip, wherein the annular surface region is disposed against an area of the floor with the annular surface region parallel to a plane defined by the floor, and wherein the annular surface region forms a gap with the floor.

35. The system of any of paragraphs 31 to 34, wherein tip is removable from the fluid-aspiration device.

36. The system of any of paragraphs 31 to 35, wherein the fluid-aspiration device is a manually operated pipette.

37. A method of transporting an emulsion, the method comprising: (A) disposing an emulsion in a well having a floor facing upward and a side wall region extending upward from the floor, the floor defining a projection; (B) placing a tip of a fluid-aspiration device into the well, the tip having an annular surface region formed at a distal end of the tip; and (C) aspirating at least a portion of the emulsion from the well through the tip.

38. The method of paragraph 37, wherein the floor is configured such that the annular surface region is capable of a larger area of engagement with a smooth flat surface than with the floor.

39. The method of paragraph 37, wherein the step of placing a tip includes a step of placing the tip against the projection.

40. A device for emulsion production, comprising: (A) a droplet generation region configured to form an emulsion; and (B) a well configured to collect the emulsion and including a floor, a side wall region extending upward from the floor, and a ceiling region disposed over the floor and defining a port configured to guide a tip of a fluid-aspiration device to the floor such that the tip is tilted with respect to the floor.

41. The device of paragraph 40, wherein the ceiling region defines a vent.

42. The device of paragraph 40 or 41, wherein the ceiling region is removably connected to the side wall region.

43. The device of paragraph 40 or 41, wherein the ceiling region is permanently attached to and/or continuous with the side wall region.

44. The device of any of paragraphs 40 to 43, wherein the port tapers toward the floor.

45. A system for emulsion processing, comprising: (A) a droplet generation region configured to form an emulsion; (B) a well configured to collect the emulsion and including a floor, a side wall region extending upward from the floor, and a ceiling region disposed over the floor and defining a port; and (C) a fluid-aspiration device equipped with a tip configured to be received in the port and advanced into contact with the floor, with the tip oriented obliquely to the floor.

46. The system of paragraph 45, wherein the port does not permit the tip to be oriented orthogonally to the floor.

47. The system of paragraph 45 or 46, wherein the fluid-aspiration device is a manually-operated pipette.

48. The system of any of paragraphs 45 to 47, wherein the tip is removable from the fluid-aspiration device.

49. A method of transporting an emulsion, the method comprising: (A) disposing an emulsion in a well having a floor, a side wall region extending upward from the floor, and a ceiling region disposed over the floor and defining a port; (B) placing a tip of a fluid-aspiration device into the well via the port, with tip oriented obliquely to the floor; and (C) aspirating at least a portion of the emulsion from the well through the tip.

50. The method of paragraph 49, wherein port defines an axis that is oblique to the floor.

51. The method of paragraph 49 or 50, wherein the port does not permit the tip to contact the floor with the tip orthogonal to the floor.

52. A method of forming a device to produce an emulsion, the method comprising: (A) providing an article having a droplet generation region operatively connected to an outlet well, the article including an upper member attached to a lower member, the lower member forming a floor of the outlet well; and (B) deforming the lower member such that the floor defines a projection.

53. The method of paragraph 52, wherein the lower member has a top surface region and a bottom surface region, and wherein the step of deforming is performed with a tool engaged with the bottom surface region of the lower member.

54. The method of paragraph 52 or 53, wherein the lower member has a top surface region and a bottom surface region, and wherein the step of deforming is performed with a tool engaged with the top surface region of the lower member.

55. The method of any of paragraphs 52 to 54, wherein the step of deforming is performed with a heated tool.

Example 7

Selected Embodiments II

This example presents selected embodiments of the present disclosure related to systems for forming, collecting, and/or aspirating an emulsion. The selected embodiments are presented as a series of numbered paragraphs.

1. A system for aspirating an emulsion, comprising: (A) a fluid-aspiration device including a tip having a flat end surrounding an inlet; and (B) a well to hold an emulsion and receive the flat end of the tip, the well including a floor having one or more surface features that prevent uninterrupted circumferential contact of the flat end of the tip with any region of the floor.

2. The system of paragraph 1, wherein the floor has a perimeter, and wherein an elevation of the floor alternately increases and decreases a plurality of times as the floor extends between opposite sides of the perimeter.

3. The system of paragraph 1 or 2, wherein the floor defines a plane, and wherein at least a portion of each surface feature is located above and/or below the plane.

4. The system of paragraph 3, wherein the floor defines at least one projection located at least partially above the plane.

5. The system of paragraph 3 or 4, wherein the floor defines at least one recess located at least partially below the plane.

6. The system of any of paragraphs 1 to 5, wherein the floor defines a plurality of ridges, a plurality of grooves, or both a plurality of ridges and a plurality of grooves.

7. The system of any of paragraphs 1 to 6, wherein the floor defines a plurality of dimples, a plurality of bumps, or both a plurality of dimples and a plurality of bumps.

8. The system of any of paragraphs 1 to 7, wherein the one or more surface features form a grid.

9. The system of any of paragraphs 1 to 8, wherein at least three of the surface features are arranged in a regular array.

10. The system of any of paragraphs 1 to 9, wherein the well includes a base portion having a top surface region forming the floor and a bottom surface region disposed opposite the top surface region, and wherein each of the one or more surface features has a complementary surface feature defined by the bottom surface region.

11. The system of paragraph 10, wherein an elevation of the floor and an elevation of the bottom surface region vary in parallel across the well.

12. The system of any of paragraphs 1 to 11, further comprising a device including the well and a droplet generation region that is fluidically connected to the well.

13. The system of any of paragraphs 1 to 12, wherein the well is provided by a device including at least one other well, and wherein the at least one other well includes a floor having a copy of the one or more surface features.

14. A device for forming and holding an emulsion to be at least partially aspirated into a tip of a fluid-aspiration device, the tip having a flat end surrounding an inlet, the device comprising: (A) a droplet generation region configured to form droplets of an emulsion; and (B) a well fluidically connected to the droplet generation region and including a floor having one or more surface features that prevent uninterrupted circumferential contact of the flat end of the tip with any region of the floor.

15. The device of paragraph 14, wherein the droplet generation region defines an orifice at which droplets are formed, wherein the orifice has a transverse dimension, and wherein each surface feature has a height or a depth of at least about one-half the transverse dimension.

16. The device of paragraph 14 or 15, wherein the droplet generation region is configured to form droplets having an average diameter, and wherein each surface feature has a height or a depth of at least about one-half the average diameter.

17. A method of emulsion transport, the method comprising: (A) disposing an emulsion including droplets in a well having a floor; (B) disposing a flat end of a tip in the well and in contact with the emulsion and the floor; (C) aspirating at least a portion of the emulsion into the tip via an inlet thereof that is surrounded by the flat end, wherein the floor defines a plane, wherein placement of the flat end of the tip against the floor parallel to the plane forms at least one passage for fluid flow under the flat end and into the tip.

18. The method of paragraph 17, wherein the floor is patterned.

19. The method of paragraph 17 or 18, wherein the floor defines one or more surface features having a nonrandom arrangement across the floor, and wherein at least one of the surface features forms at least part of the at least one passage.

20. The method of any of paragraphs 17 to 19, further comprising a step of forming the emulsion with a droplet generation region fluidically connected to the well.

21. The method of any of paragraphs 17 to 20, wherein the at least one passage has a height that is greater than an average diameter of the droplets.

22. A method of fluid manipulation, the method comprising: (A) forming an emulsion; (B) disposing at least a portion of the emulsion in a well having a floor; (C) disposing a flat end of a tip in the well; (D) aspirating at least a portion of the emulsion into the tip via an inlet of the tip that is surrounded by the flat end, wherein the floor of the well has one or more surface features that prevent uninterrupted circumferential contact of the flat end of the tip with any region of the floor.

23. The method of paragraph 22, wherein the one or more surface features have a nonrandom arrangement across the floor.

24. The method of paragraph 22 or 23, wherein the step of forming an emulsion is performed with a droplet generation region that is fluidically connected to the well.

25. The method of any of paragraphs 1 to 24, wherein the step of disposing at least a portion of the emulsion is performed at least partially while the droplets are being formed.

26. A device for emulsion production, comprising: (A) a droplet generation region configured to form droplets of an emulsion; and (B) a well configured to collect the emulsion and including a floor, a side wall region extending upwardly from the floor, and a guide region disposed over the floor and defining a port configured to guide a tip of a fluid-aspiration device to the floor such that the tip is tilted with respect to the floor.

27. The device of paragraph 26, wherein the port tapers toward the floor.

28. A system for emulsion formation and transport, comprising: (A) a droplet generation region configured to form an emulsion; (B) a well configured to collect the emulsion and including a floor, a side wall region extending upwardly from the floor, and a ceiling region disposed above the floor and defining a port; and (C) a fluid-aspiration device equipped with a tip having a bottom end capable of being advanced through the port and into contact with the floor, wherein the port is configured to orient the tip obliquely with respect to the floor.

29. The system of paragraph 28, wherein the port does not permit the tip to be oriented exactly normal to the floor.

30. A method of transporting an emulsion, the method comprising: (A) disposing an emulsion in a well having a floor, a side wall region extending upwardly from the floor, and a guide region disposed over the floor and defining a port; (B) placing a tip of a fluid-aspiration device into the well via the port such that the tip is oriented obliquely with respect to the floor by the port; and (C) aspirating at least a portion of the emulsion from the well into the tip while the tip remains obliquely oriented.

31. The method of paragraph 30, wherein port defines an axis that is oblique to the floor.

32. The method of paragraph 30 or 31, wherein the port does not permit the tip to contact the floor with the tip exactly normal to the floor.

33. A method of modifying a well for holding an emulsion to be aspirated with a fluid-aspiration device including a tip having a flat end, the method comprising: deforming a floor or a prospective floor of a well to produce one or more surface features that prevent uninterrupted circumferential contact of the flat end with any region of the floor or prospective floor.

34. The method of paragraph 33, wherein the step of deforming is performed by contact between the floor or prospective floor and a tool.

35. The method of paragraph 33, wherein the well has a base portion having an upper surface region forming the floor and opposite a lower surface region under the floor, and wherein the step of deforming is performed with a tool in contact with the lower surface region under the floor or prospective floor.

36. The method of any of paragraphs 33 to 35, wherein the well is fluidically connected to a droplet generation region when the step of deforming is performed.

37. The method of any of paragraphs 33 to 36, wherein the well has a side wall portion provided by an upper member, and wherein the floor or prospective floor is provided by a distinct lower member.

38. The method of paragraph 37, wherein the step of deforming is performed on the floor at least partially after the lower member is attached to the upper member.

39. The method of paragraph 37 or 38, wherein the step of deforming is performed on the lower member at least partially before the lower member is attached to the upper member.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure. Further, ordinal indicators, such as first, second, or third, for identified elements are used to distinguish between the elements, and do not indicate a particular position or order of such elements, unless otherwise specifically stated.

We claim:

1. A device for forming and holding an emulsion to be at least partially aspirated into a tip of a fluid-aspiration device, the tip having a flat end surrounding an inlet, the device comprising:

a sample input channel;

one or more carrier input channels;

a droplet output channel;

a droplet generation region configured to form droplets of an emulsion, the droplet generation region being created where the sample input channel, the one or more carrier input channels, and the droplet output channel meet one another; and an outlet well fluidically connected to the droplet generation region via the droplet output channel, the outlet well including a floor having one or more surface features that prevent uninterrupted circumferential contact of the flat end of the tip with the floor.

2. The device of claim 1, wherein the droplet generation region is configured to form droplets having an average diameter, and wherein each surface feature has a height or a depth of at least about one-half the average diameter.

3. The device of claim 1, wherein the floor defines a plurality of ridges, a plurality of grooves, or both a plurality of ridges and a plurality of grooves.

4. The device of claim 1, wherein the one or more surface features are positioned nonrandomly across the floor.

5. The device of claim 1, wherein the well includes a bottom surface region disposed opposite the floor, and wherein the bottom surface region defines one or more surface features that are complementary to each of the one or more surface features of the floor.

6. A device for forming and holding an emulsion, comprising:

a sample input channel;

one or more carrier input channels;

a droplet output channel;

a droplet generation region configured to form droplets of an emulsion, the droplet generation region being created where the sample input channel, the one or more carrier input channels, and the droplet output channel meet one another; and an outlet well fluidically connected to the droplet generation region via the droplet output channel and configured to collect droplets of the emulsion, the well having a floor facing upward and a side wall region extending upward from the floor, wherein the floor defines a projection.

7. The device of claim 6, wherein the floor has a perimeter, and wherein the elevation of the floor alternately increases and decreases a plurality of times as the floor extends between opposite sides of the perimeter.

8. The device of claim 6, wherein the floor defines a plurality of projections.

9. The device of claim 8, wherein the projections include a plurality of ridges.

10. The device of claim 9, wherein the ridges are parallel to one another.

11. The device of claim 9, wherein the ridges intersect to form a grid pattern.

12. The device of claim 6, wherein the floor defines a two-dimensional array of projections.

13. The device of claim 6, wherein the well includes a base having a bottom surface region disposed under the floor, and wherein the bottom surface region varies in elevation in correspondence with the elevation of the floor.

14. The device of claim 6, wherein the device includes a plurality of wells, wherein each well has a floor defining a projection, and wherein each well is configured to collect an emulsion formed by a different droplet generation region.

15. The device of claim 6, wherein the floor has a texture produced by a patterned surface region.

16. The device of claim 6, wherein the floor is horizontal and generally planar.

17. The device of claim 6, wherein the droplet generation region is configured to form droplets having an average diameter, and wherein the floor has an elevation that varies by at least about one-half the average diameter.

* * * * *